US007182724B2

(12) United States Patent
South

(10) Patent No.: US 7,182,724 B2
(45) Date of Patent: Feb. 27, 2007

(54) DISPOSABLE CENTRIFUGE ROTOR

(75) Inventor: Kevin C. South, Cookeville, TN (US)

(73) Assignee: Fleetguard, Inc., Nashville, TN (US)

( * ) Notice: Subject to any disclaimer, the term of this patent is extended or adjusted under 35 U.S.C. 154(b) by 167 days.

(21) Appl. No.: 10/786,957

(22) Filed: Feb. 25, 2004

(65) Prior Publication Data

US 2005/0187091 A1 Aug. 25, 2005

(51) Int. Cl.
*B04B 7/08* (2006.01)
*B04B 9/06* (2006.01)

(52) U.S. Cl. ..... 494/49

(58) Field of Classification Search ..... 494/24, 494/36, 43, 49, 64, 65, 67, 83, 84, 901; 210/168, 210/171, 232, 360.1, 380.1, 416.5; 184/6.24
See application file for complete search history.

(56) References Cited

U.S. PATENT DOCUMENTS

| | | | | |
|---|---|---|---|---|
| 3,432,091 | A * | 3/1969 | Beazley | 494/65 |
| 3,762,633 | A * | 10/1973 | Ishii | 494/83 |
| 4,221,323 | A * | 9/1980 | Courtot | 494/49 |
| 5,637,217 | A | 6/1997 | Herman et al. | |
| 6,095,964 | A | 8/2000 | Purvey | |
| 6,224,531 | B1 | 5/2001 | Frehland et al. | |
| 6,354,987 | B1 | 3/2002 | Frehland et al. | |
| 6,424,067 | B1 * | 7/2002 | Samways | 494/83 |
| 6,428,700 | B1 | 8/2002 | Brown et al. | |
| 6,457,868 | B1 | 10/2002 | Fischer et al. | |
| 6,517,475 | B1 | 2/2003 | Brown et al. | |
| 6,520,902 | B1 | 2/2003 | Brown et al. | |
| 6,530,872 | B2 | 3/2003 | Frehland et al. | |
| 6,551,230 | B2 | 4/2003 | Herman et al. | |
| 6,579,218 | B1 | 6/2003 | May et al. | |
| 2001/0016549 | A1 | 8/2001 | Herman et al. | |
| 2002/0034347 | A1 | 3/2002 | Fischer et al. | |
| 2002/0045526 | A1 | 4/2002 | Herman et al. | |
| 2002/0049126 | A1 | 4/2002 | Herman et al. | |
| 2002/0088445 | A1 | 7/2002 | Weindorf et al. | |
| 2002/0107132 | A1 | 8/2002 | Fischer et al. | |
| 2002/0119883 | A1 | 8/2002 | Herman et al. | |
| 2002/0128140 | A1 | 9/2002 | Frehland et al. | |
| 2003/0162645 | A1 * | 8/2003 | South et al. | 494/49 |
| 2005/0187091 | A1 * | 8/2005 | South | 494/49 |

FOREIGN PATENT DOCUMENTS

| | | | |
|---|---|---|---|
| EP | 1 217 183 | A1 | 11/2001 |
| WO | 01/00327 | A1 | 1/2001 |
| WO | 01/74492 | A2 * | 10/2005 |

* cited by examiner

*Primary Examiner*—Charles E. Cooley
(74) *Attorney, Agent, or Firm*—Krieg DeVault LLP

(57) ABSTRACT

A disposable, all-plastic centrifuge rotor for fluid processing includes a unitary, molded plastic upper rotor portion that includes a rotor shaft spud. A unitary, molded plastic lower rotor portion is provided and is joined to the upper rotor portion so as to define a hollow rotor interior. Positioned within the hollow rotor interior is a unitary baseplate that is joined to the lower rotor portion and includes a rotor shaft spud. The rotor shaft spud of the unitary baseplate extends through the lower rotor portion and beyond the lower rotor portion and is coaxial with the rotor shaft spud of the upper rotor portion. A spiral vane element is positioned in the rotor interior and is captured between the upper rotor portion and the baseplate for fluid processing as the centrifuge rotor rotates at a high RPM rate.

15 Claims, 11 Drawing Sheets

DISPOSABLE CENTRIFUGE ROTOR

BACKGROUND OF THE INVENTION

The present invention relates generally to fluid centrifuges that are constructed and arranged to separate particulate matter from a supply of fluid. More specifically, the present invention pertains to a fully disposable, molded plastic centrifuge rotor that is constructed and arranged without the need to use any metallic bushings or other metallic parts or components.

One consideration in the design and/or redesign of fluid processing and fluid filtering components, such as a centrifuge rotor, is whether the component(s) can be constructed and arranged so as to be nonmetallic or at least predominantly nonmetallic. A component design or assembly design that is predominantly nonmetallic, preferably all plastic, is considered to be "disposable" since it can be incinerated for disposal or it can be recycled, depending on the selected materials. By providing a component construction that is incinerateable, the structural mass of the component(s) can be reduced to low volume ash and this limits what will be added to landfills. The other option for "disposal" is to recycle the plastics used in the construction of the component(s) or assembly. Presently, when there is a construction for fluid processing and fluid filtering components that is substantially all plastic, the components or the assembly or subassembly of those components is described as having an environmentally friendly, "green" design.

A further aspect of redesigning components in order to achieve an all-plastic construction is the elimination of metallic parts that typically represent a higher cost compared to the plastic replacement. When it is possible to mold the replacement part or feature as part of another existing component, then it is possible to eliminate one or more assembly steps and this represents a cost savings in terms of labor.

One of the applications for an all-plastic construction is in the design of a centrifuge rotor. One current design that includes a stack of particulate separator cones within the rotor includes metal bushings that are pressed into the plastic rotor housing. At each oil change, when the rotor is discarded, the metal bushings are also discarded, even though they have only seen less than five percent (5%) of their useful life. Additionally, these metal bushings have to be pressed out of the rotor housing before the rotor can be incinerated. The desire for a fully disposable, "green" product and concerns over costs related to the metal bushings have driven the conception of the present invention. By eliminating the metal bushings, the cost of the component parts is saved as well as eliminating the labor time to press the bushings into the rotor housing and to press them out of the housing before disposing of the rotor.

An improvement related to the elimination of all metal bushings from the centrifuge rotor, according to the present invention, is the design and use of a molded plastic rotor shaft spud as a unitary portion of an upper rotor portion. A similar molded plastic rotor shaft spud is provided as a unitary portion of a baseplate component, comprising part of the centrifuge rotor. These rotor shaft spuds provide the rotor/bearing surfaces for rotation of the centrifuge rotor relative to the centrifuge shell or housing. When these rotor shaft spuds are unitarily molded as a symmetrical part of a larger component, i.e., the upper rotor portion and the baseplate, potential out-of-roundness concerns can be minimized.

SUMMARY OF THE INVENTION

A disposable centrifuge rotor for fluid processing according to one embodiment of the present invention comprises a unitary upper rotor portion including a rotor shaft spud, a unitary lower rotor portion joined to the upper rotor portion to define a rotor interior, a unitary baseplate positioned in the rotor interior and being received by the lower rotor portion, the baseplate including a rotor shaft spud extending through and beyond the lower rotor portion, and a fluid processing element positioned in the rotor interior.

One object of the present invention is to provide an improved disposable centrifuge rotor.

Related objects and advantages of the present invention will be apparent from the following description.

DESCRIPTION OF THE PREFERRED EMBODIMENTS

Figure 1:
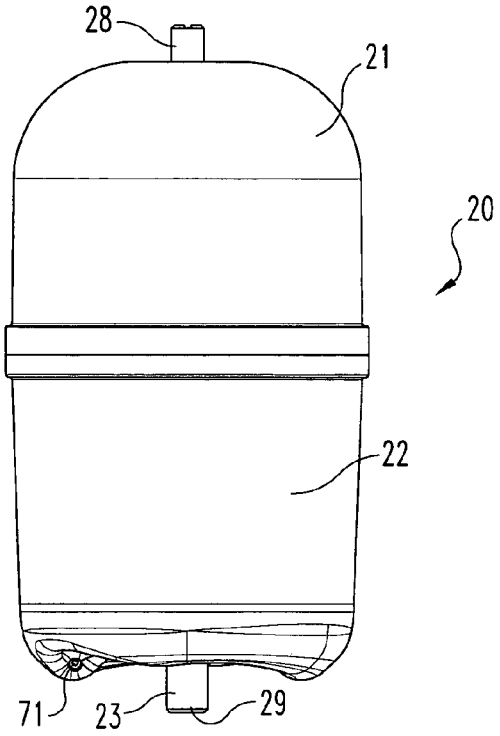
FIG. 1 is a front elevational view of a disposable centrifuge rotor according to a typical embodiment of the present invention.
Figure 2:
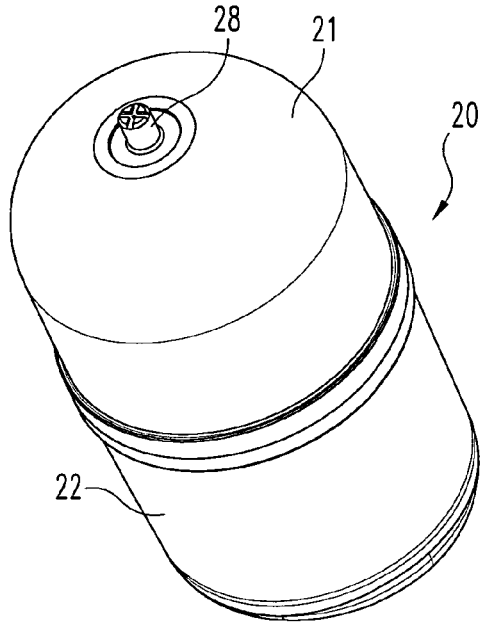
FIG. 2 is a top perspective view of the FIG. 1 centrifuge rotor.
Figure 3:
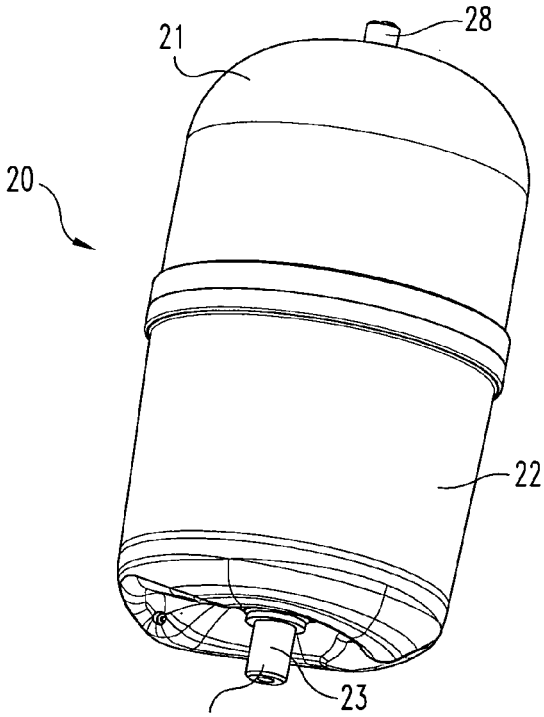
FIG. 3 is a bottom perspective view of the FIG. 1 centrifuge rotor.
Figure 4:
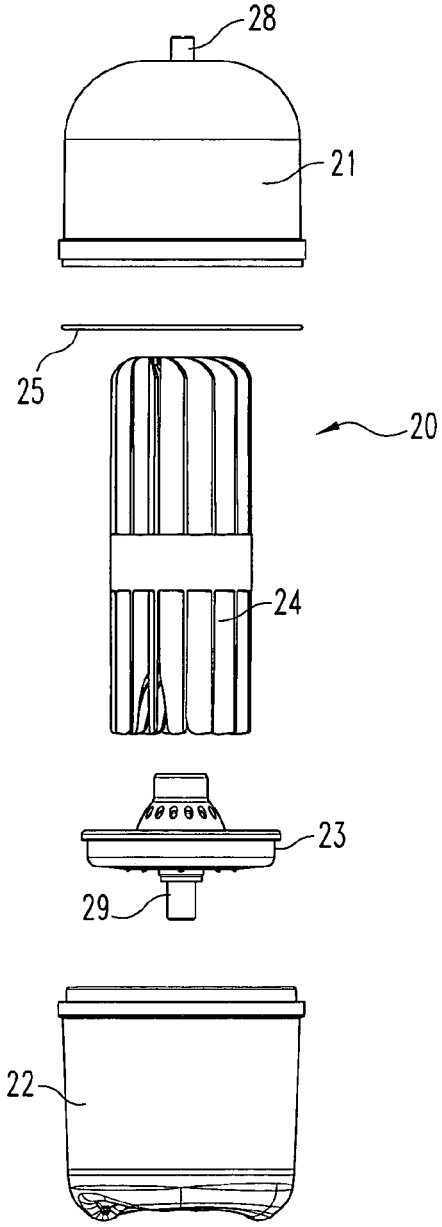
FIG. 4 is a front elevational, exploded view of the FIG. 1 centrifuge rotor.
Figure 5:
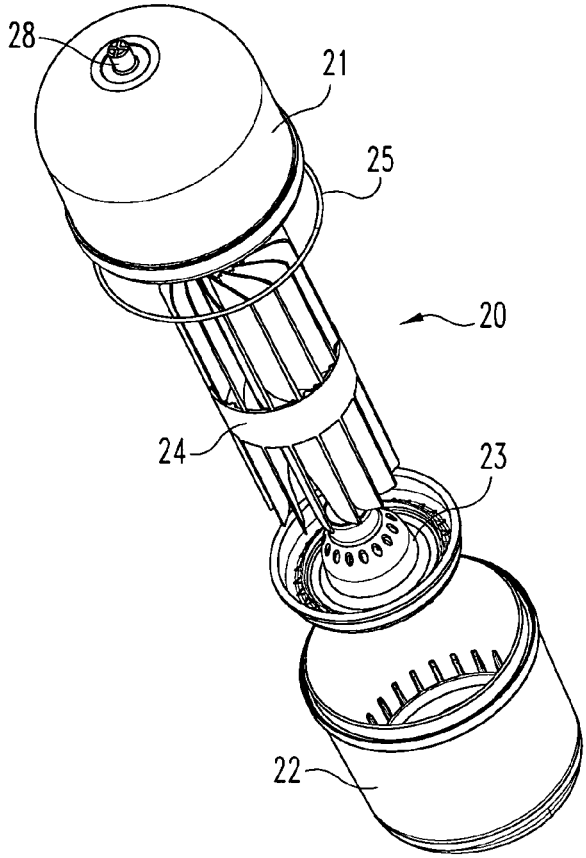
FIG. 5 is a top perspective, exploded view of the FIG. 1 centrifuge rotor.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1–6, there is illustrated a centrifuge rotor 20 according to one embodiment of the present invention. Centrifuge rotor 20 includes an annular upper rotor portion 21, an annular lower rotor portion 22, an annular baseplate 23, a spiral vane element 24, and an Emabond® strand 25. Upper and lower rotor portions 21 and 22, respectively, are joined together to create a shell or housing and cooperate to define a hollow rotor interior. The baseplate 23 and the spiral vane element 24 are assembled into the hollow rotor interior. As will be described, the lower rotor portion receives the baseplate and the baseplate, in cooperation with the upper rotor portion, receives and positions the spiral vane element 24.

Figure 20:
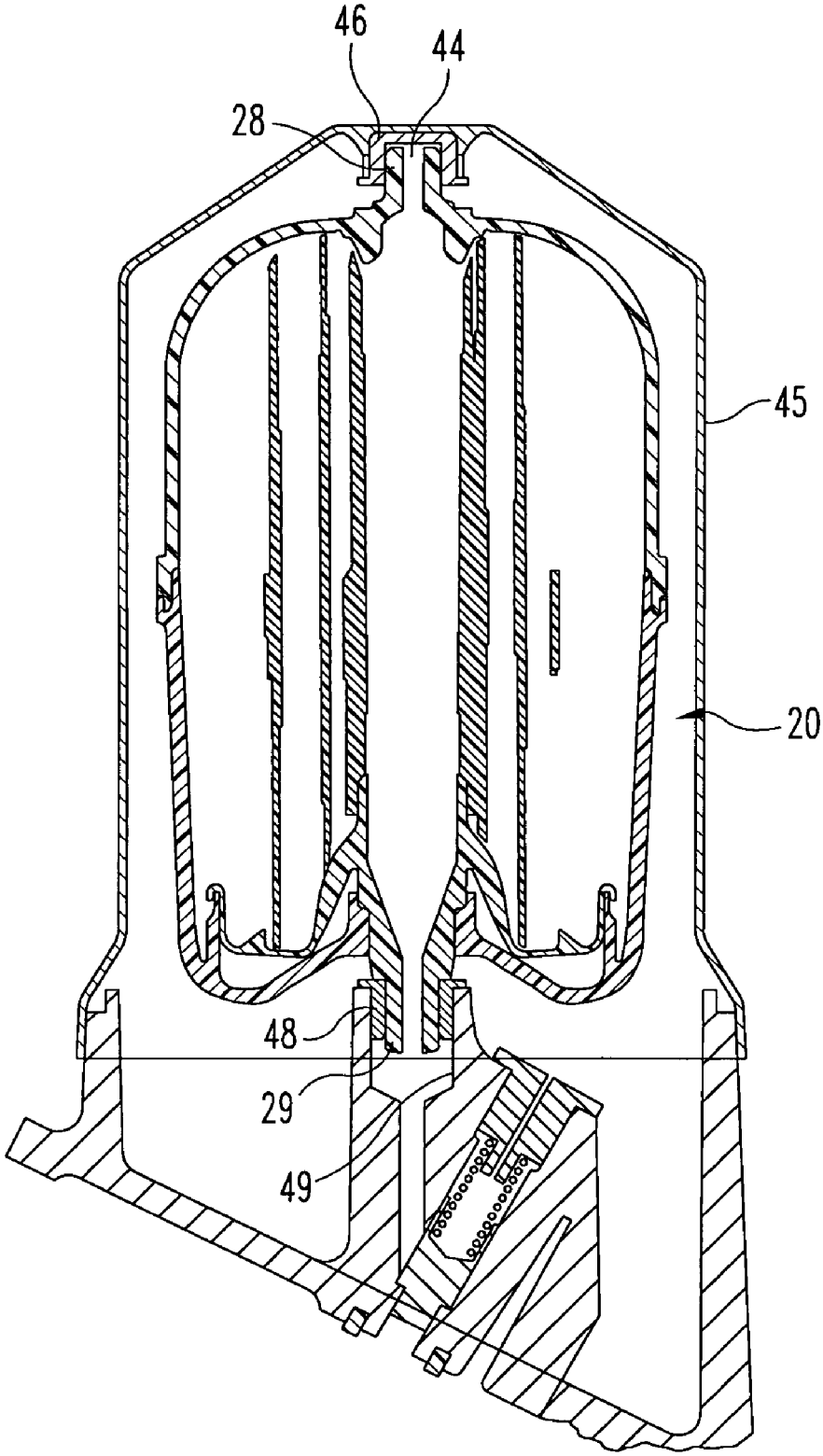
FIG. 20 is a front elevational view, in full section, of the FIG. 1 centrifuge rotor as assembled into a centrifuge, according to the present invention.

In FIG. 20, centrifuge rotor 20 is assembled into a centrifuge that can be described as a "top load centrifuge" with the fluid inlet at the base or bottom of the centrifuge. If the centrifuge housing is inverted, such that the fluid inlet location of the base is at the top, this can be described as a "bottom load centrifuge". However, the construction and orientation of centrifuge rotor 20 does not change and is suitable for either a top load centrifuge or a bottom load centrifuge.

In this first embodiment, the upper rotor shaft created by spud 28 is a unitary part of upper rotor portion 21. The lower rotor shaft created by spud 29 is a unitary part of baseplate 23. As illustrated and described, spud 29, which is a unitary part of the baseplate 23, extends through lower rotor portion 22 and actually extends beyond the lower rotor portion a sufficient distance to be received by the centrifuge housing (see FIGS. 20 and 21). The portion of spud 29 extending beyond the outer surface of the lower rotor portion 22 is the bearing surface for the assembly into the bushing in the centrifuge housing of FIG. 20. The references to "upper" and "lower" are used in the context of the FIG. 20 assembly orientation.

The upper rotor portion 21 is a one-piece molded, plastic component. The lower rotor portion 22 is a one-piece molded, plastic component. In the first alternate embodiment of the present invention, as illustrated by FIGS. 13–16, the upper rotor shaft spud 30 and the lower rotor shaft spud 31 are each molded as separate, discrete components to be assembled into the upper rotor portion 32 and into the lower rotor portion 33, respectively. The assembly of the rotor shaft spuds 30 and 31 is from the exterior of each receiving component, in an inward direction. Further, rotor shaft spuds 30 and 31 are of an identical construction. This identical construction for spuds 30 and 31 simplifies the overall design and reduces the different part count by one (1).

Figure 17:
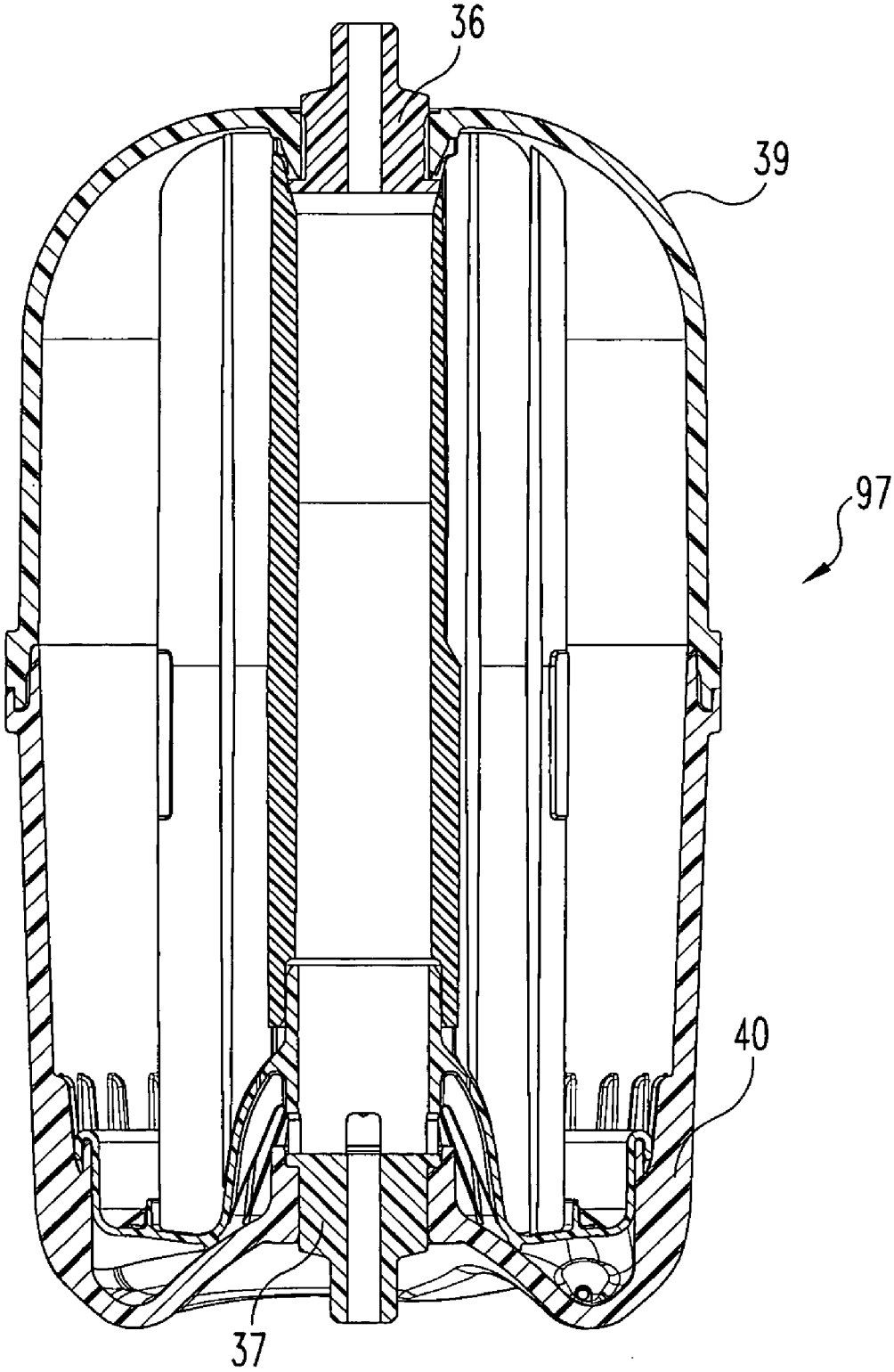
FIG. 17 is a front elevational view, in full section, of a centrifuge rotor according to another embodiment of the present invention.
Figure 18:
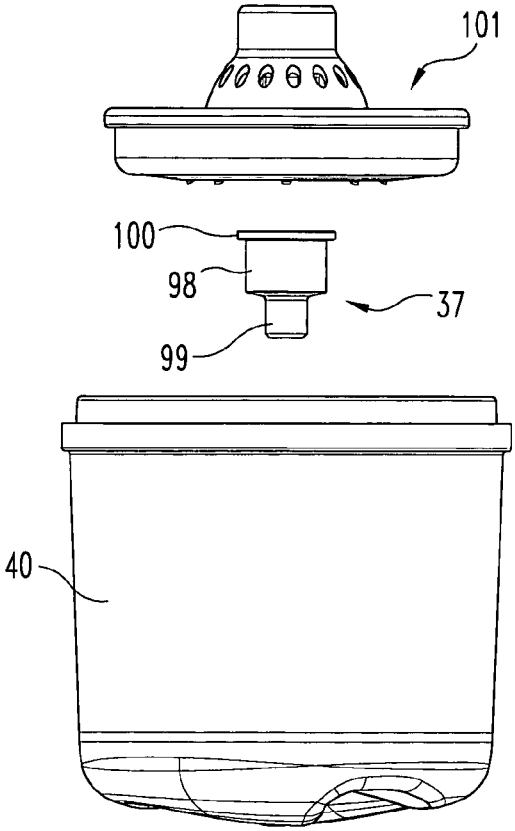
FIG. 18 is an exploded, front elevational view, of a lower portion of the FIG. 17 centrifuge rotor.
Figure 19:
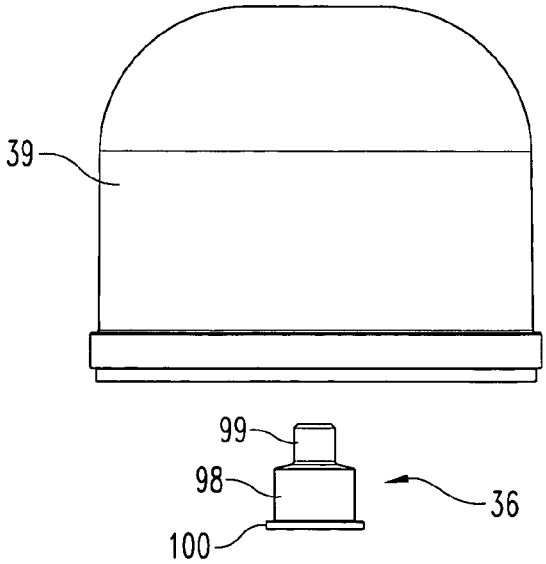
FIG. 19 is an exploded, front elevational view of an upper portion of the FIG. 17 centrifuge rotor.

In another embodiment of the present invention, as illustrated by FIGS. 17–19, the upper rotor shaft spud 36 and the lower rotor shaft spud 37 are each molded as separate, discrete components to be assembled into the upper rotor portion 39 and into the lower rotor portion 40, respectively. The assembly of the rotor shaft spuds 36 and 37 is from the interior of each receiving component, outwardly. Further, rotor shaft spuds 36 and 37 are of an identical construction. This simplifies the overall design and reduces the different part count by one (1).

With continued reference to FIGS. 1–6, and with reference to FIGS. 7–12, the baseplate 23 is illustrated as a one-piece, molded plastic component. The spiral vane element 24 is a one-piece, molded plastic component. The upper rotor portion 21 is illustrated in full section in FIG. 7 and this drawing shows the manner in which the upper spud 28 is unitarily molded as part of the upper rotor portion 21. Frustoconical portion 43 fits into and helps to align the spiral vane element 24, see FIG. 6. Spud 28 includes a fluid metering bore 44 that extends coaxially through the geometric center of spud 28. The use of bore 44 for fluid delivery is explained in the context of FIG. 20 which illustrates the assembly of centrifuge rotor 20 into the centrifuge shell or housing 45. In FIG. 20, the housing 45 includes an annular, metal, flanged bushing 46 that is pressed into the housing wall from the inside of the housing 45. The bushing 46 is closed at one end and open at the opposite end. The spud 28 is coaxially received by the open end of bushing 46. The fluid delivery bore 44 is constructed and arranged to deliver a metered flow of fluid into the interior of bushing 46 so as to lubricate the running surfaces of the bushing 46 and spud 28 combination. This "metered" flow is controlled by the annular clearance between the bushing and spud. This style of top spud/bushing interface can also be incorporated into a split-chamber centrifuge as the flow outlet.

Figure 21:
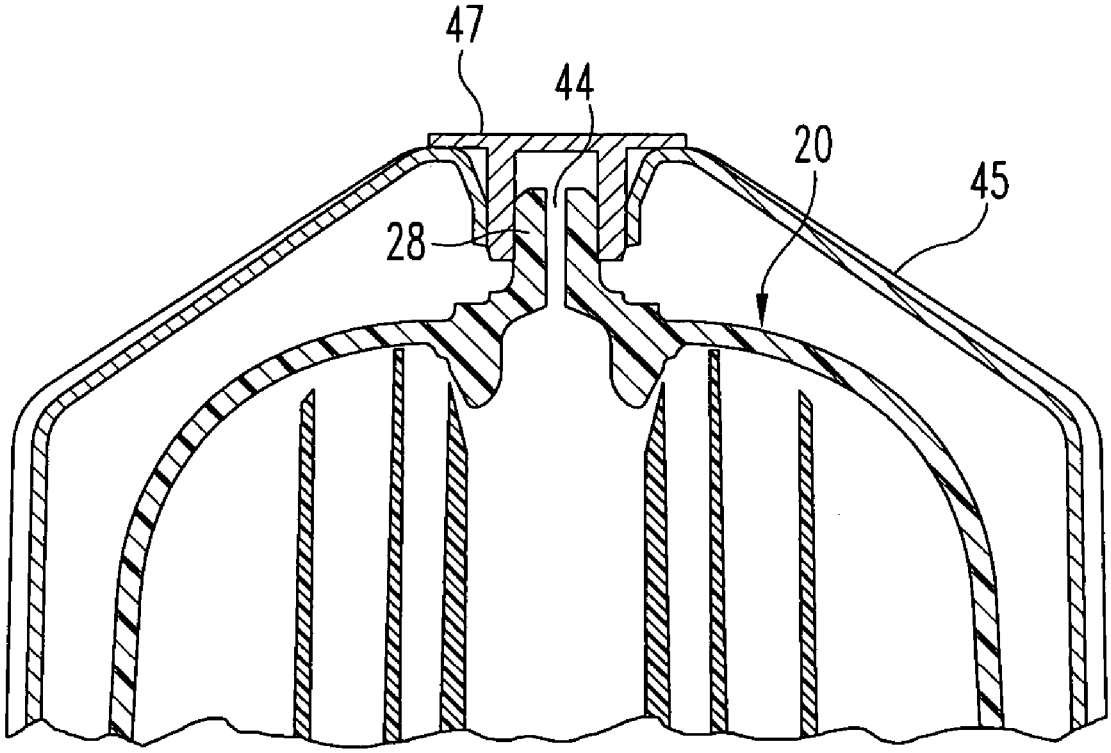
FIG. 21 is a partial, front elevational view, in full section, of the FIG. 1 centrifuge rotor as assembled into an alternate centrifuge, according to the present invention.

In FIG. 21, the housing 45 includes an annular, metal, flanged bushing 47 that is pressed into the housing wall from the outside of the housing 45. The bushing 47 is closed at one end and open at the opposite end. The spud 28 is coaxially received by the open end of bushing 47. The fluid delivery bore 44 is constructed and arranged to deliver fluid into the interior of bushing 47 so as to lubricate the running surfaces of the bushing 47 and spud 28 combination. The portion of spud 28 extending beyond the outer surface of the upper rotor portion 21 is the bearing surface for the assembly into bushing 46 (or bushing 47).

One alternative to what is illustrated in FIGS. 20 and 21 is to eliminate bushings 46 and 47, respectively, and simply drill and ream a smaller blind hole in housing 45 to receive rotor shaft spud 28. A similar change can be made to the base where bushing 48 receives rotor shaft spud 29. If bushing 48 is eliminated, bore 49 is reduced in diameter size to be properly sized to receive spud 29.

Figure 6:
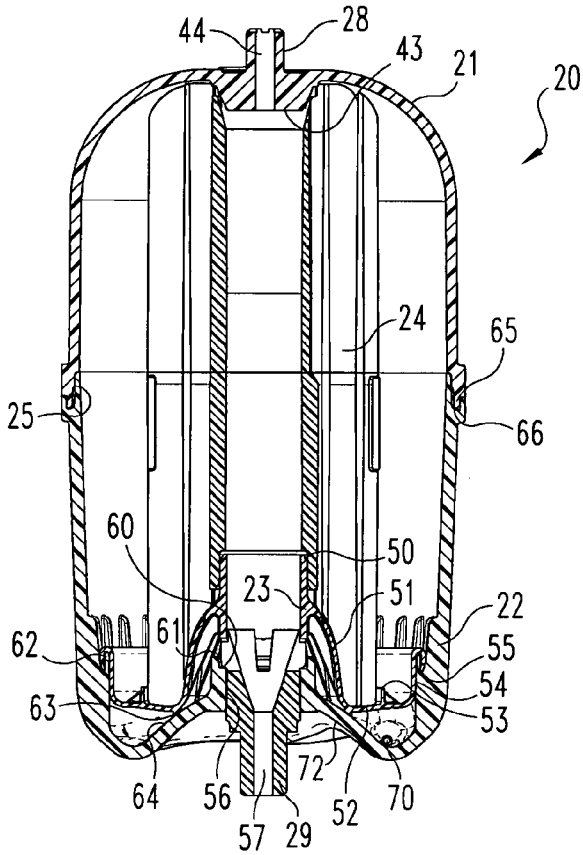
FIG. 6 is a front elevational view, in full section, of the FIG. 1 centrifuge rotor.
Figure 7:
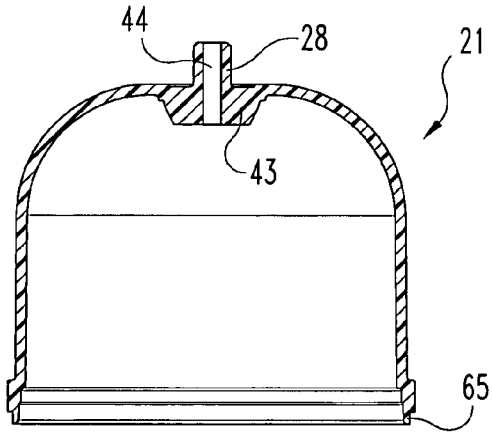
FIG. 7 is a front elevational view, in full section, of a rotor shell upper portion comprising part of the FIG. 1 centrifuge rotor.
Figure 8:
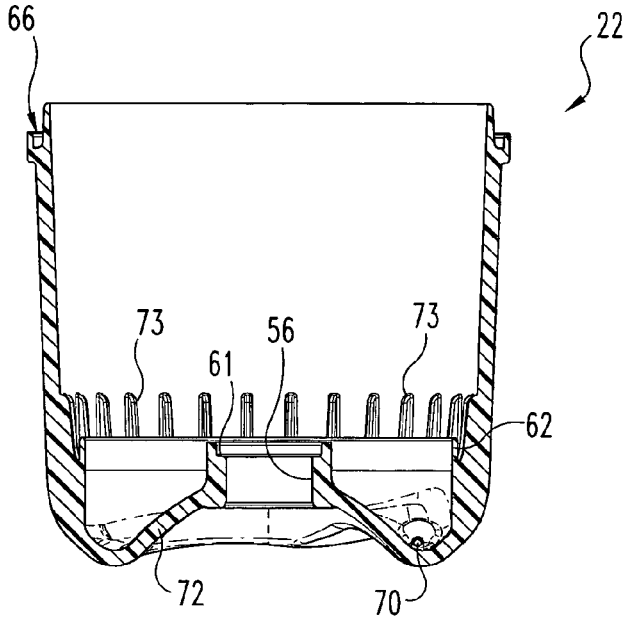
FIG. 8 is a front elevational view, in full section, of a rotor shell lower portion comprising part of the FIG. 1 centrifuge rotor.

Continuing with the FIG. 6 assembly drawing, baseplate 23 includes a centertube portion 50 that fits up into spiral vane element 24. Curved annular wall 51 extends from centertube portion 50 to a lower annular shelf 52 that includes an interior annular wall 53 and a peripheral outer wall 54 with an inverted U-shaped annular channel 55. Spud 29 extends through opening 56 in the lower rotor portion 22 and includes a flow bore 57 communicating with the hollow interior of the spiral vane element 24. Shoulder 60 of baseplate 23 seats up against shoulder 61 of lower rotor portion 22. Additionally, channel 55 receives raised interior annular wall 62 that is a unitary part of the lower rotor portion 22. Channel 55 and wall 62 are securely joined together for support and liquid-tight sealing at that annular interface. This joining can be achieved by a spin weld, ultrasonic weld, interference fit, or by the use of adhesive, to name some of the options. Additional support for baseplate 23 is provided by the contact of abutments 63 against surface 64.

The spiral vane element 24 seats down into baseplate 23 and is positioned against shelf 52 between wall 51 and wall 53. The inner edge of the lower portion of each vane is shaped so as to fit around curved annular wall 51. The upper rotor portion 21 and the lower rotor portion 22 are joined together such that spuds 28 and 29 are coaxially aligned for efficient rotary motion of centrifuge rotor 20 within centrifuge housing 45, as illustrated in FIGS. 20 and 21. The annular form of spiral vane element 24 cooperates with the coaxial alignment of spuds 28 and 29 and centertube portion 50 (also coaxial) such that spiral vane element 24 is maintained in a centered and balanced vertical orientation.

The joining together of the upper and lower rotor portions 21 and 22, respectively, includes the interfit of annular lip 65 of upper rotor portion 21 into the annular channel 66 of lower rotor portion 22. If the Emabond® strand 25 is used, it fits into this annular joint and the Emabond® process is used to help create the necessary liquid-tight annular seal. A mechanical connection between the two rotor portions can also be achieved by a quarter-turn or half-turn bayonet connection, by a threaded connection, by a spin weld, or by any similar technique that keeps the two rotor portions securely joined together during their high speed rotation and with a sufficient seal to prevent fluid leakage.

The all-plastic construction of centrifuge rotor 20 provides what can be described as being fully disposable and environmentally friendly. Disposal can be by means of incineration or it can be by means of recycling the plastic. One key to this improvement is the elimination of metal parts, specifically the elimination of any metal bushings that would be pressed into the rotor portions in prior art designs, such as rotor portions 21 and 22. When metal bushings are a part of a centrifuge rotor, they rarely see more than five percent of their useful life. The metallic construction yields a part that is quite durable with a comparatively long useful life. However, the rotor accumulates sludge and, at some point, the separation efficiency of the element diminishes to the degree that the centrifuge rotor must be replaced. This rotor replacement occurs long before any metal bushings have reached the end of their useful life. Disposing of the metal bushings with disposal of the centrifuge rotor is considered a waste in terms of component part cost and labor. Before incineration or recycling, the metal bushings must be pressed out of the rotor portions.

With spuds 28 and 29 functioning as rotor shafts, the bushings are pressed into the centrifuge housing, such as bushings 46 and 47 being pressed into housing 45, as illustrated in FIGS. 20 and 21. This construction allows those bushings to realize their full useful life. As noted, this provides cost benefits in terms of saving the component part cost and eliminating the labor cost for the assembly and disassembly of the bushings. The present invention also provides an improved, more desirable product compared to the prior art in that by molding spud 28 as part of upper rotor portion 21, one part is fabricated as opposed to two. This again saves labor time, but it also results in reducing, if not eliminating, any out-of-roundness concerns. When a shaft is separately molded and assembled into a bore of a separately molded component, such as the upper rotor portion or baseplate, there can be a slight out-of-roundness mismatch in the circumferential symmetry and balance between these two parts. When these two parts are intended to rotate together at a high RPM rate, effectively acting as an integral unit, any molding mismatch in terms of part symmetry may result in an out-of-roundness problem or balance issue that contributes to rotor inefficiency. When spud 28 is molded as a part of upper rotor portion 21 as a unitary component, the single part symmetry can be controlled to a higher degree. This in turn reduces any out-of-roundness and contributes to better rotor balance and more efficient high speed rotation. This same concern exists with spud 29 and baseplate 23 and is solved in the same manner, by molding the rotor shaft spud 29 as part of the baseplate 23 into a unitary, molded plastic component, as illustrated and described.

Additional structural details regarding the component parts of centrifuge rotor 20 include, for the lower rotor portion 22, a pair of oppositely positioned tangential flow nozzle openings 70 and 71 defined by lower wall 72. These two flow nozzle openings 70 and 71 cooperate with the exiting fluid to create a self-driven centrifuge rotor. Lower rotor portion 22 also includes reinforcing ribs 73 positioned around the inner surface 74.

Figure 9:
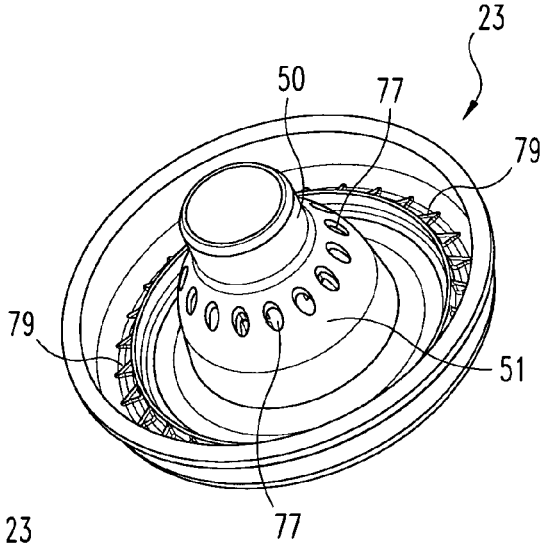
FIG. 9 is a top perspective view of a baseplate comprising part of the FIG. 1 centrifuge rotor.
Figure 10:
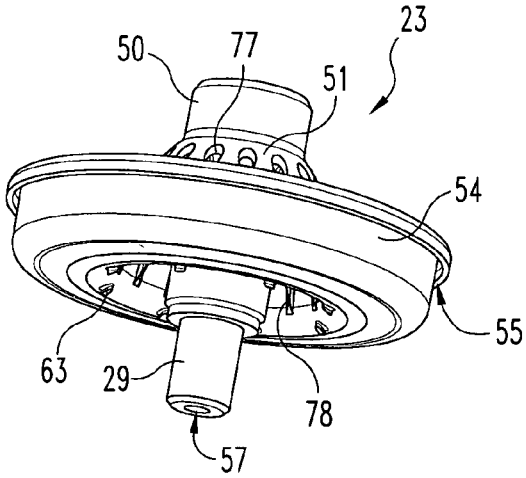
FIG. 10 is bottom perspective view of the FIG. 9 baseplate.
Figure 11:
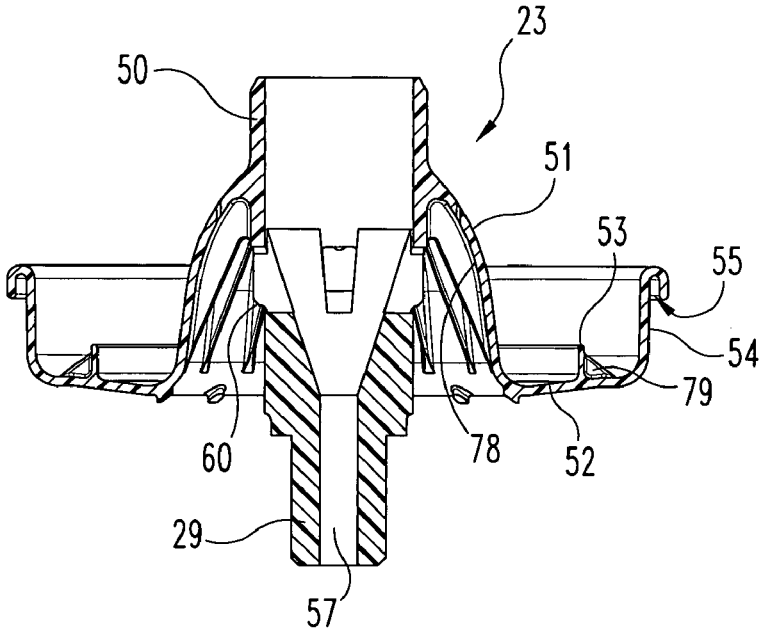
FIG. 11 is a front elevational view, in full section, of the FIG. 9 baseplate.
Figure 12:
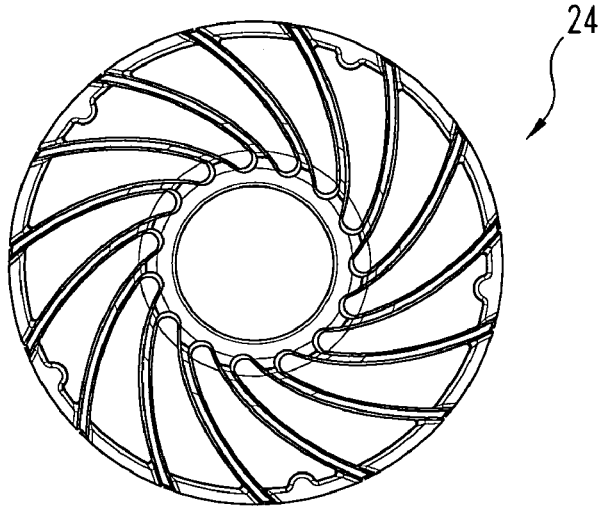
FIG. 12 is a top plan view of a spiral vane element comprising part of the FIG. 1 centrifuge rotor.
Figure 13:
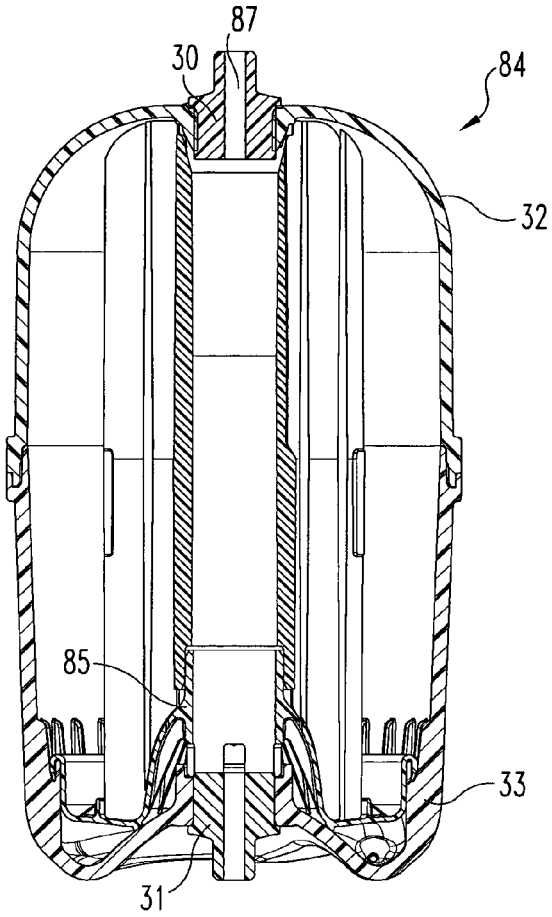
FIG. 13 is a front elevational view, in full section, of a centrifuge rotor according to another embodiment of the present invention.

Continuing with the description of additional structural details and with reference to FIGS. 9–11, baseplate 23 includes a series of oval flow holes 77 defined by curved annular wall 51. Holes 77 are equally spaced apart and provide the flow path for the existing fluid prior to reaching the two flow nozzles 70 and 71. Baseplate 23 also includes a series of equally-spaced reinforcing ribs 78 on the interior of wall 51 and a series of equally spaced reinforcing ribs 79 positioned between wall 53 and shelf 52. The unitary, molded plastic construction of baseplate 23 permits the molding of ribs 78 and 79 without any added cost, except the incremental cost of material. However, the use of plastic with the option for thinner sections, while desirable in terms of weight and cost, may require strengthening and additional rigidity and ribs 78 and 79 contribute to achieving these requirements.

Referring now to FIGS. 13–16 and the first alternate embodiment, the upper and lower rotor shaft spuds 30 and 31 are separate component parts of centrifuge rotor 84 and are inserted into their corresponding rotor portions 32 and 33, respectively. When the two spuds 30 and 31 are not constructed and arranged as unitary parts of the upper rotor portion 32 (spud 30) and the baseplate 85 (spud 31), these other components are redesigned. Accordingly, the upper rotor portions 21 and 32 are configured differently with regard to the area for locating spud 28, as a comparison between FIGS. 7 and 15 will indicate. Instead of the unitary construction for upper rotor portion 21 with spud 28, upper rotor portion 32 defines a cylindrical spud bore 86 that is constructed and arranged to receive spud 30 with a sliding fit. The secure and leak-tight joining of spud 30 into bore 86 of upper rotor portion 32 can be achieved by means of a spin weld, ultrasonic weld, press-fit, or with the use of a suitable adhesive, to name some of the options. Spud 30 preserves the lubrication bore 87 for introducing oil into the interior of bushing 46 (or bushing 47) in order to lubricate the running surfaces. Except for the differences noted, specifically replacing the unitary construction with bore 86, the remainder of upper rotor portion 32 is identical to upper rotor portion 21.

Figure 14:
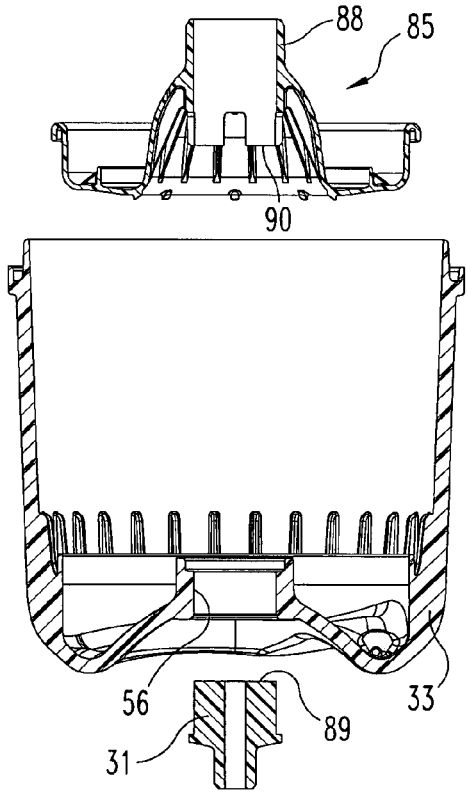
FIG. 14 is an exploded, front elevational view, in full section, of a lower portion of the FIG. 13 centrifuge rotor.
Figure 15:
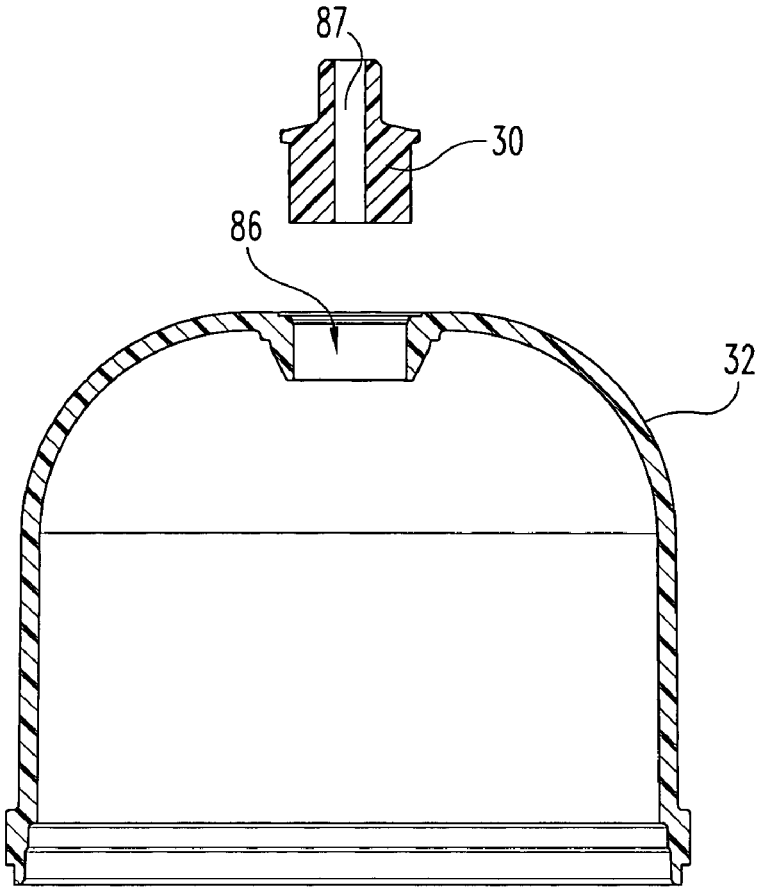
FIG. 15 is an exploded, front elevational view, in full section, of an upper portion of the FIG. 13 centrifuge rotor.

With regard to the use of spud 31 and the modification to the baseplate as a result of this design change, reference is made to the differences between baseplate 23, as illustrated in FIG. 1, and baseplate 85, as illustrated in FIG. 14. As illustrated, the centertube 88 ends at a location below channel 55 and above shelf 52. Since the only design difference to baseplate 23 due to the elimination of spud 29 involves centertube portion 50, common reference numbers for baseplate 85 have been used except for identification of centertube 88. With this new configuration for baseplate 85, and providing spud 31 as a separate component, the spud 31 is inserted into opening 56 with a sliding fit. The upper end 89 of spud 31 abuts up against the lower end 90 of centertube 88. The secure and leak-tight joining of spud 31 into opening 56 of lower rotor portion 33 can be achieved by means of a spin weld, ultrasonic weld, press-fit, or by the use of a suitable adhesive, to name some of the options. Lower rotor portion 33 is constructed and arranged such that it is identical to lower rotor portion 22. Since opening 56 does not change, it is constructed and arranged to receive spud 29 or alternatively to receive spud 31.

Figure 16:
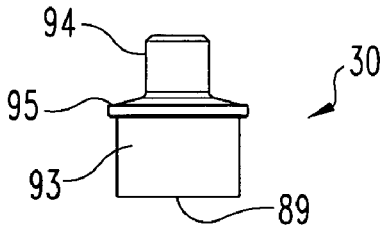
FIG. 16 is a front elevational view of a rotor shaft spud member comprising part of the FIG. 13 centrifuge rotor.

Referring to FIG. 16, spud 30 is illustrated and is identical to spud 31. Bore 87 is used in spud 30 for lubricating fluid delivery and in spud 31 this bore is used for fluid delivery into the spiral vane element 24. Spud 30 includes a cylindrical main body 93, coaxial rotor shaft 94, and abutment lip 95. The abutment lip 95 of spud 30 abuts up against upper rotor portion 32 while lip 95 of spud 31 abuts up against lower rotor portion 33. The portion of each spud 30 and 31 that extends beyond the outer surface of the corresponding rotor portion provides the bearing surface for receipt by the bushings that are assembled into the centrifuge housing.

Referring now to FIGS. 17–19 and the second alternate embodiment, the upper and lower spuds 36 and 37 are identical to one another and are inserted into the upper rotor portion 39 and lower rotor portion 40, respectively. The assembly of the spuds 36 and 37 into the corresponding rotor portions 39 and 40 is by way of a sliding fit. There is a secure and leak-free joining of the spuds into the rotor portions that can be achieved by means of a spin weld, ultrasonic weld, press-fit, or by the use a suitable adhesive, to name some of the options. The primary difference between the first alternate embodiment of FIGS. 13–16 and the second alternate embodiment of FIGS. 17–19 is that spuds 30 and 31 are inserted from the exterior of the rotor portions while spuds 36 and 37 are inserted from the interior of the rotor portions. Otherwise, the construction of centrifuge rotor 97 is virtually identical to the construction of centrifuge rotor 84.

Spuds 36 and 37 each include a body 98, rotor shaft 99, and abutment lip 100. When inserting a rotor shaft spud from the exterior of a rotor portion, the abutment lip is located on the spud as illustrated in FIG. 16. When inserting a rotor shaft spud from the interior of a rotor portion, the abutment lip is located on the spud as illustrated in FIG. 19. This change in the abutment lip location for spuds 36 and 37 also results in a minor design change for baseplate 101 in terms of the centertube configuration. The design of the lower rotor portion 40 does not change from what is illustrated for lower rotor portion 33. The portion of each spud 36 and 37 that extends beyond the outer surface of the corresponding rotor portion provides the bearing surface for receipt by the bushings that are assembled into the centrifuge housing.

The two alternate embodiments disclosed in FIGS. 13–16 and in FIGS. 17–19 provide all of the disposable characteristics and features described for centrifuge rotor 20, including the elimination of any metal bushings or other metallic parts. This creates the same environmentally friendly construction for centrifuge rotors 84 and 97 as has been described for centrifuge rotor 20.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A disposable centrifuge rotor for fluid processing, said centrifuge rotor comprising:

a unitary first rotor portion including, as a part of its unitary construction, a first rotor shaft spud;

a unitary second rotor portion joined to said first rotor portion to define a rotor interior;

a unitary baseplate positioned in said rotor interior and being received by said second rotor portion, said baseplate including, as a part of its unitary construction, a second rotor shaft spud extending through and beyond said second rotor portion; and a fluid processing element positioned in said rotor interior.

2. The centrifuge rotor of claim 1 wherein said first rotor portion is an all-plastic component of said centrifuge rotor.

3. The centrifuge rotor of claim 2 wherein said second rotor portion is an all-plastic component of said centrifuge rotor.

4. The centrifuge rotor of claim 3 wherein said baseplate is an all-plastic component of said centrifuge rotor.

5. The centrifuge rotor of claim 1 wherein said first rotor shaft spud includes a first bearing surface and said second rotor shaft spud includes a second bearing surface that is coaxially aligned with said first bearing surface.

6. A disposable centrifuge rotor for fluid processing, said centrifuge rotor comprising:

a unitary, molded plastic first rotor portion;

a plastic first rotor shaft spud assembled into said first rotor portion, said first rotor shaft spud defining an interior passage for fluid delivery through said first rotor shaft spud;

a unitary, molded plastic second rotor portion joined to said first rotor portion to define a rotor interior;

a unitary, molded plastic baseplate positioned in said rotor interior and being received by said second rotor portion;

a plastic second rotor shaft spud assembled into said second rotor portion and defining a bearing surface extending beyond said second rotor portion, said first rotor shaft spud having a bearing surface that is coaxially aligned with the bearing surface of said second rotor shaft spud, said second rotor shaft spud defining an interior passage for fluid delivery through said second rotor shaft spud; and a fluid processing element positioned in said rotor interior and being received by said baseplate.

7. The centrifuge rotor of claim 6 wherein each rotor shaft spud includes an abutment lip that is constructed and arranged to abut up against an outer surface of its corresponding rotor portion.

8. The centrifuge rotor of claim 6 wherein each rotor shaft spud includes an abutment lip that is constructed and arranged to abut up against an inner surface of its corresponding rotor portion.

9. A disposable centrifuge rotor for fluid processing, said centrifuge rotor comprising:

a unitary, molded plastic first rotor portion;

a plastic first rotor shaft spud joined to said first rotor portion, said first rotor shaft spud defining a fluid bore;

a unitary, molded plastic second rotor portion joined to said first rotor portion to define a rotor interior;

a unitary, molded plastic baseplate positioned in said rotor interior and being received by said second rotor portion;

a plastic second rotor shaft spud joined to said second rotor portion and defining a bearing surface extending beyond said second rotor portion, said first rotor shaft spud having a bearing surface that is coaxially aligned with the bearing surface of said second rotor shaft spud, said second rotor shaft spud defining a fluid bore;

a fluid processing element positioned in said rotor interior; and wherein the construction and arrangement of said first rotor shaft spud is the same as the construction arrangement of said second rotor shaft spud.

10. The centrifuge rotor of claim 9 wherein each rotor shaft spud includes an abutment lip that is constructed and arranged to abut up against an outer surface of its corresponding rotor portion.

11. The centrifuge rotor of claim 9 wherein each rotor shaft spud includes an abutment lip that is constructed and arranged to abut up against an inner surface of its corresponding rotor portion.

12. A disposable centrifuge rotor for fluid processing, said centrifuge rotor comprising:

a unitary, molded plastic first rotor portion;

a plastic first rotor shaft spud joined to said first rotor portion;

a unitary, molded plastic second rotor portion joined to said first rotor portion to define a rotor interior;

a unitary, molded plastic baseplate positioned in said rotor interior and being received by said second rotor portion;

a plastic second rotor shaft spud joined to said second rotor portion and defining a bearing surface extending beyond said second rotor portion, said first rotor shaft spud having a bearing surface that is coaxially aligned with the bearing surface of said second rotor shaft spud;

a fluid processing element positioned in said rotor; and wherein the construction and arrangement of said first rotor shaft spud is the same as the construction and arrangement of said second rotor shaft spud.

13. A disposable centrifuge rotor for fluid processing, said centrifuge rotor comprising:

a unitary, molded plastic first rotor portion;

a plastic first rotor shaft spud joined to said first rotor portion;

a unitary, molded plastic second rotor portion joined to said first rotor portion to define a rotor interior;

a unitary, molded plastic baseplate positioned in said rotor interior and being received by said second rotor portion;

a plastic second rotor shaft spud joined to said second rotor portion and defining a bearing surface extending beyond said second rotor portion, said first rotor shaft spud having a bearing surface that is coaxially aligned with the bearing surface of said second rotor shaft spud;

a fluid processing element positioned in said rotor; and wherein each rotor shaft spud includes an abutment lip that is constructed and arranged to abut up against a surface of its corresponding rotor portion.

14. A disposable centrifuge rotor for fluid processing, said centrifuge rotor comprising:

a unitary first rotor portion including, as a part of its unitary construction, a first rotor shaft spud;

a unitary second rotor portion joined to said first rotor portion to define a rotor interior;

a unitary baseplate positioned in said rotor interior and being received by said second rotor portion;

a second rotor shaft spud assembled into said second rotor portion and defining a bearing surface extending beyond said second rotor portion, said first rotor shaft spud having a bearing surface that is coaxially aligned with the bearing surface of said second rotor shaft spud; and a fluid processing element positioned in said rotor interior and being received by said baseplate.

15. A disposable centrifuge rotor for fluid processing, said centrifuge rotor comprising:

a unitary first rotor portion;

a first rotor shaft spud assembled into said first rotor portion;

a unitary second rotor portion joined to said first rotor portion to define a rotor interior;

a unitary baseplate positioned in said rotor interior and being received by said second rotor portion, said baseplate including, as a part of its unitary construction, a second rotor shaft spud extending through and beyond said second rotor portion; and a fluid processing element positioned in said rotor interior.

* * * * *